US008813705B2

(12) United States Patent
Christgen et al.

(10) Patent No.: US 8,813,705 B2
(45) Date of Patent: Aug. 26, 2014

(54) HYDRAULIC SUPPORT ELEMENT

(75) Inventors: Wolfgang Christgen, Seukendorf (DE); Juergen Kretschmer, Fuerth (DE); Melanie Stark, Herzogenaurach (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 13/462,316

(22) Filed: May 2, 2012

(65) Prior Publication Data

US 2012/0279386 A1 Nov. 8, 2012

(30) Foreign Application Priority Data

May 2, 2011 (DE) ..... 10 2011 075 042

(51) Int. Cl.
*F01L 1/18* (2006.01)
*F01L 1/14* (2006.01)

(52) U.S. Cl.
USPC ..... 123/90.46; 123/90.55

(58) Field of Classification Search
USPC ..... 123/90.39–90.58
See application file for complete search history.

(56) References Cited

U.S. PATENT DOCUMENTS

| | | | | | |
|---|---|---|---|---|---|
| 2,737,934 | A * | 3/1956 | Banker | ..... | 123/90.59 |
| 4,387,675 | A * | 6/1983 | Hori et al. | ..... | 123/90.58 |
| 4,584,976 | A * | 4/1986 | Hillebrand | ..... | 123/90.55 |
| 4,840,153 | A * | 6/1989 | Aida et al. | ..... | 123/90.55 |
| 4,887,566 | A * | 12/1989 | Shida | ..... | 123/90.51 |
| 4,920,935 | A * | 5/1990 | Shida | ..... | 123/90.51 |
| 5,979,377 | A * | 11/1999 | Barth et al. | ..... | 123/90.12 |
| 6,439,186 | B1 * | 8/2002 | Owen et al. | ..... | 123/90.55 |
| 2005/0178351 | A1 * | 8/2005 | Mayer et al. | ..... | 123/90.48 |

FOREIGN PATENT DOCUMENTS

| | | |
|---|---|---|
| DE | 19942983 | 3/2001 |
| DE | 102004006903 | 9/2005 |
| DE | 102006007375 | 8/2007 |
| DE | 102006007376 | 8/2007 |
| DE | 102006017442 | 10/2007 |
| DE | 102006045017 | 3/2008 |

* cited by examiner

*Primary Examiner* — Thomas Denion
*Assistant Examiner* — Steven D Shipe
(74) *Attorney, Agent, or Firm* — Simpson & Simpson, PLLC

(57) ABSTRACT

A hydraulic support element having a housing, a pressure piston, a high pressure chamber for a hydraulic means extending between a bottom face of the pressure piston and a bottom of the housing, wherein the housing includes a passage for the hydraulic means, which communicates radially inwardly with an aperture in the pressure piston, wherein the pressure piston includes a deflecting sheath for the hydraulic means, tightly contacting the pressure piston at the interior jacket axially below the aperture and extending to the proximity of a head of the pressure piston, wherein a rising line for the hydraulic means is formed between the deflecting sheath and the interior jacket, which starts at the aperture and leads in the area of the head into a reservoir inside the deflecting sheath directly in front of the return valve and with the deflecting sheath having at least one perforation axially above its contact.

17 Claims, 1 Drawing Sheet

HYDRAULIC SUPPORT ELEMENT

CROSS-REFERENCE TO RELATED APPLICATIONS

This patent claims priority from German Patent Application No. DE 10 2011 075 042.8, filed May 2, 2011, which application is incorporated herein by reference in its entirety.

FIELD OF THE INVENTION

The invention relates to a hydraulic support element for a valve drive of an internal combustion engine, having a housing, holding a pressure piston in its bore, with a high pressure chamber for a hydraulic means, extending between a bottom face of the pressure piston and a bottom of the housing, which can be sealed by a return valve open in its direction, with the housing including a passage for the hydraulic means, which radially inside communicates with an aperture in the pressure piston, with the pressure piston including a deflecting sheath for the hydraulic means, which tightly contacts the interior jacket of the pressure piston axially below the aperture and which extends to the proximity of the head of the pressure piston penetrating the housing, with a rising line for the hydraulic means being formed between the deflecting sheath and the interior jacket, which starts at the aperture and leads in the area of the head into a reservoir inside the deflecting sheath directly in front of the return valve and by which the high pressure can be provided from the reservoir via the hydraulic means.

BACKGROUND OF THE INVENTION

Such a support element is discernible from German Patent Application No. 10 2004 006 902 A1. A deflecting sheath provides an area directly in front of the return valve, and thus, in front of the high pressure reservoir, largely free from air bubbles, formations of foaming oil, and eddies. Because of the way the hydraulic means is stored in the reservoir in a "tranquilized fashion," compressibility of the high pressure chamber is well eliminated so that a cam stroke always shows the desired gas exchange cross-section.

However, it is also determined that when starting the motor the deflecting sheath ultimately represents an undesired barrier for a sufficiently fast supply of the hydraulic means, so that in the worst-case-scenario air can be suctioned into the high pressure chamber, which due to the undesired increased closing speed of the gas exchange valve may lead to raffling noises (valve tickers).

Therefore, the objective of the invention is to prevent the above-mentioned disadvantages.

BRIEF SUMMARY OF THE INVENTION

One object of the invention, is to provide a deflecting sheath having at least one perforation, such as a slot, a window, a bore, etc., axially above its contacting point at the interior jacket of the pressure piston.

This way, a hydraulic support element is provided, which may also be of a switchable nature. The deflecting sheath shows an improved permeability for a hydraulic means in the inlet direction, so that when starting the motor sufficient amounts of the hydraulic means are always accumulated in front of the return valve, which ensures a proper compensation of play. Simultaneously it is ensured that the storage and the tranquilizing function of the deflecting sheath are maintained.

In one embodiment, the at least one perforation (slot, bore, window, etc) is located circumferentially offset in reference to the aperture of the pressure piston. This way, any direct influx of the hydraulic means into the reservoir is more or less avoided, which otherwise could lead to eddying. At least one perforation is beneficially located axially clearly distanced from the bottom face of the pressure piston with the return valve.

In another embodiment, where the at least one perforation is a longitudinal slot, it may also be embodied as a lip opening in the direction towards the reservoir (radially inwardly), which hinders any drainage of the reservoir when the motor is stationary or which ensures that a comparatively large amount of hydraulic means is stored in the reservoir.

The deflecting sheath may be produced in a non-cutting manner from sheet steel, in which at least one longitudinal slot, for example, starts at one edge of the deflecting sheath and may be produced by a simple cutting process.

In yet another embodiment, the deflecting sheath extends below the aperture tightly at the bottom face of an annular recess of the pressure piston and is welded and/or latched thereat, for example.

It is also provided to divide the pressure piston. Here, its production is facilitated. The two axial components may be simply placed upon each other or bonded with each other, e.g., welded. Here, at least one component may be produced from light materials, such as sheet steel.

The throttled ventilation opening allows the ventilation of undesired air from the flow of the hydraulic means already before the hydraulic means entering the reservoir.

Additionally, in another embodiment, it is provided to produce the rising line either circumferentially at the exterior jacket of the deflecting sheath or to embody it at least as a ring segment. Alternatively, a channel-like embodiment is possible. The rising line may also be formed either in the sheath or at the interior jacket of the pressure piston.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

Figure 1:
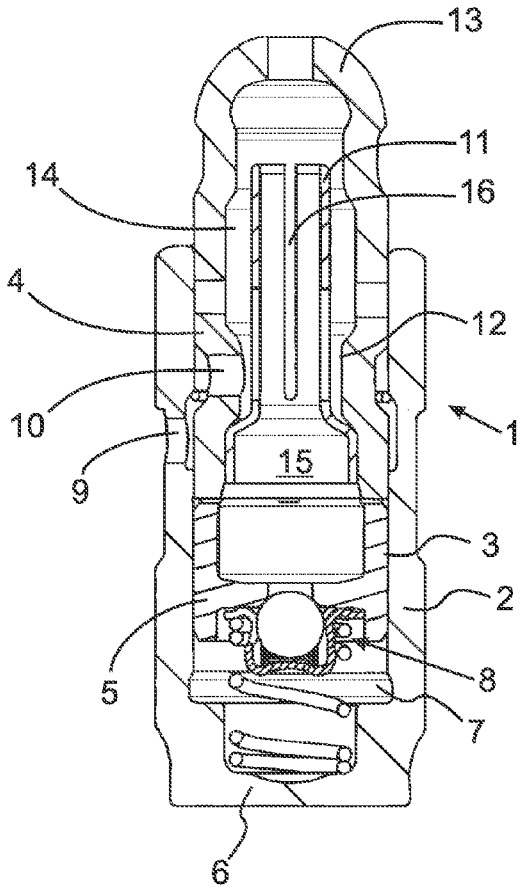
FIG. 1 is a longitudinal cross-sectional view through a hydraulic support element with a continuously slotted deflecting sheath; and, FIG. 2 is a view similar to that of FIG. 1, however with a deflection sheath, which is not continuously slotted.

At the outset, it should be appreciated that like drawing numbers on different drawing views identify identical, or functionally similar, structural elements of the invention. While the present invention is described with respect to what is presently considered to be the preferred aspects, it is to be understood that the invention as claimed is not limited to the disclosed aspects.

Furthermore, it is understood that this invention is not limited to the particular methodology, materials and modifications described and, as such, may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the preferred methods, devices, and materials are now described.

Hydraulic support element 1 is shown for a valve drive of an internal combustion engine. It includes pot-shaped housing 2, with axially mobile pressure piston 4 being located in bore 3. The piston projects from housing 2 with head 13 serving as the stop of a rocker arm.

High pressure chamber 7 for the hydraulic means extends between bottom face 5 of pressure piston 4 and bottom 6 of housing 2. It can be sealed by return valve 8 located at bottom face 5 and opening in its direction.

Figure 2:
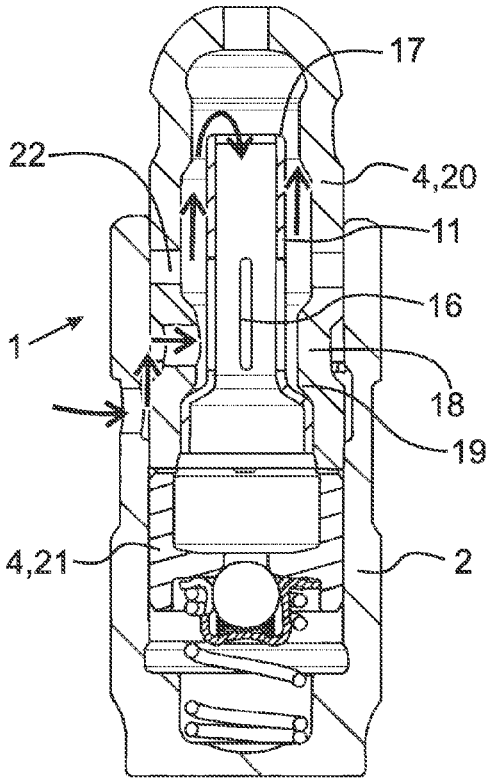

Housing 2 has passage 9 for the hydraulic means, which hydraulic means communicates radially inside with aperture 10 in pressure piston 4. As shown in FIGS. 1 and 2, pressure piston 4 includes deflecting sheath 11 for the hydraulic means. It is axially fastened in a sealing fashion underneath aperture 10 at interior jacket 12 of pressure piston 4. Aperture 10 is located in annular formation 18 of pressure piston 4, with deflection sheath 11 contacting lower annular shoulder 19 of annular recess 18.

Deflecting sheath 11 extends to the proximity of head 13. Rising line 14 for the hydraulic means (also see the arrow illustrated in FIG. 2) is formed between deflecting sheath 11 and interior jacket 12, which starts at aperture 10 and leads in the area of head 13 into reservoir 15 inside deflecting sheath 11 directly in front of return valve 8.

As illustrated in FIG. 1, deflecting sheath 11 includes perforation 16 axially above its contact at interior jacket 12 of pressure piston 4, preferably as an oblong slot, which extends to edge 17. As shown in FIG. 2, several oblong slots are provided, distributed over the circumference, which end axially below edge 17.

After the internal combustion engine has come to a halt and after its restarting deflecting sheath 11 ensures, on the one hand, that the hydraulic means is provided, it is largely free from air bubbles as well as "tranquilized," in front of return valve 8. On the other hand, the hydraulic means reaches via at least one perforation 16, preferably offset in reference to aperture 10, into reservoir 15 in an "accelerated" fashion.

Furthermore, as shown in the figures, pressure piston 4 inside housing 2 includes two physically separated axial sections, including upper section 20 with deflecting sheath 11 and lower section 21 with bottom face 5 and return valve 8.

Any air still present in the flow of hydraulic means can be ventilated prior to entering reservoir 15 via ventilation opening 22, shown in the two figures in the left half of the illustration and located axially above passage 10, but still inside housing 2.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

LIST OF REFERENCE NUMBERS

1 support element
2 housing
3 bore
4 pressure piston
5 bottom face
6 bottom
7 high pressure chamber
8 return valve
9 passage
10 aperture
11 deflecting sheath
12 interior jacket
13 head
14 rising line
15 reservoir
16 perforation
17 edge
18 annular recess
19 annular shoulder
20 upper section
21 lower section
22 ventilation opening

What is claimed is:

1. A hydraulic support element comprising:
- a housing, having a bore, a first bottom face, and a passage for a hydraulic means;
- a pressure piston, located within the bore and including, an interior jacket, a head projecting from the housing, a second bottom face, and an aperture in communication with the passage;
- a return valve;
- a reservoir directly in front of the return valve;
- a high pressure chamber, for the hydraulic means, extending between the first and second bottom faces, which can be sealed by the return valve;
- a deflecting sheath for the hydraulic means:
  - which tightly contacts the interior jacket of the pressure piston axially below the aperture;
  - which extends to the proximity of the head of the pressure piston; and,
  - including:
    - an edge furthest from the high pressure chamber; and,
    - at least one perforation:
      - connected to the edge;
      - interrupting the edge; and,
      - axially extending from the edge in a first direction, the first direction from the deflecting sheath toward the high pressure chamber; and,
      - including a portion aligned with the aperture in a second direction orthogonal to the first direction; and,
- a rising line for the hydraulic means, formed between the deflecting sheath and the interior jacket, which starts at the aperture and extends in an area of the head into the reservoir, wherein high pressure can be provided from the reservoir via the hydraulic means.

2. The hydraulic support element as recited in claim 1, wherein the at least one perforation is a slot, a window, or a bore.

3. The hydraulic support element as recited in claim 1, wherein the at least one perforation is offset in a circumferential direction in reference to the aperture.

4. The hydraulic support element as recited in claim 1, wherein the at least one perforation is distributed over a circumference.

5. The hydraulic support element as recited in claim 1, wherein the at least one perforation is oblong in shape, extending to an edge of the deflecting sheath at a side of the head.

6. The hydraulic support element as recited in claim 1, wherein the aperture in the pressure piston extends in an annular recess of the pressure piston, wherein the deflecting sheath, starting at a bottom annular shoulder, shows a tight fit at the interior jacket of the pressure piston.

7. The hydraulic support element as recited in claim 1, wherein the pressure piston inside the housing comprises two physically separate axial sections, wherein the first axial section is an upper section with the deflecting sheath and the second axial section is a lower section with the bottom face and the return valve.

8. The hydraulic support element as recited in claim 1, wherein the pressure piston comprises at least one ventilating opening axially above the aperture but inside the housing.

9. The hydraulic support element as recited in claim 1, wherein the rising line is implemented as a segment-like or overall circumferential annular line.

10. The hydraulic support element as recited in claim 1, wherein the deflection sheath is a thin-walled light-construction part.

11. The hydraulic support element as recited in claim 10, wherein the deflection sheath is a sheet metal part.

12. The hydraulic support element as recited in claim 1, wherein the deflecting sheath is secured to the interior jacket of the pressure piston.

13. The hydraulic support element as recited in claim 1, wherein the deflecting sheath is secured via latching, welding, soldering, clipping, or adhering.

14. The hydraulic support element as recited in claim 1, wherein the at least one perforation is a sealing lip under the impingement of the hydraulic means opening in the direction of the reservoir.

15. A hydraulic support element, comprising:
- a housing including:
  - a bore;
  - a passage connecting the bore to an exterior of the housing; and,
  - a first bottom face;
- a pressure piston located within the bore and including:
  - an aperture open to the bore;
  - a head projecting from the housing;
  - a reservoir; and,
  - a second bottom face;
- a return valve;
- a high pressure chamber located between the first and second bottom faces, which can be sealed by the return valve;
- a deflecting sheath located within the pressure piston and including:
  - a wall with:
    - a first axial end:
      - furthest from the high pressure chamber in an axial direction extending from the high pressure chamber to the first axial end; and,
      - including a first opening with an edge formed by the wall; and
    - a second axial end closest to the high pressure chamber in the axial direction; and,
  - at least one first perforation in the wall:
    - with a first end open to the edge; and,
    - extending away from the edge, in the axial direction, to a second end of the at least one first perforation; and,
  - at least one second perforation in the wall separated, in the axial direction, from the first and second axial ends of the deflecting sheath by first and second different portions of the wall, respectively; and,
- a rising line for a hydraulic means, formed between the deflecting sheath and the pressure piston, which starts at the first aperture and extends in an area of the head into the reservoir, wherein:
  - the wall is parallel to the axial direction;
  - high pressure can be provided from the reservoir via the hydraulic means; and,
  - a line in the axial direction passes through:
    - the first and second ends of the at least one second perforation;
    - the first and second different portions of the cylindrical wall; and,
    - the first axial end of the deflecting sheath.

16. A hydraulic support element, comprising:
- a housing including:
  - a bore;
  - a passage connecting the bore to an exterior of the housing; and,
  - a first bottom face;
  - a return valve;
  - a reservoir; and
  - a high pressure chamber, which can be sealed by the return valve;
- a pressure piston located within the bore and including:
  - a second bottom face;
  - a first end including a head projecting from the housing;
  - a first aperture open to the bore and aligned with the housing in a radial direction;
  - a second aperture open to the bore and including a portion aligned with the first aperture in the radial direction;
  - a third aperture:
    - open to the bore;
    - located, in an axial direction, orthogonal to the radial direction, between the first aperture and the high pressure chamber; and,
    - aligned with the housing in the radial direction; and
  - a deflecting sheath located within the pressure piston and including:
    - a portion extending in the axial direction from a distal end of the deflecting sheath and having a uniform width in the radial direction; and,
    - at least one first perforation located in the portion and aligned with each of the first, second, and third apertures in the radial direction; and
- a rising line for a hydraulic means, formed between the deflecting sheath and the pressure piston, which starts at the first aperture and extends in an area of the head into the reservoir, wherein:
  - the high pressure chamber is between the first and second bottom faces; and,
  - high pressure can be provided from the reservoir via the hydraulic means.

17. The hydraulic support element of claim 16, wherein:
- the deflecting sheath includes an axial end furthest from the high pressure chamber in the axial direction;
- the at least one first perforation opens to the axial end; and,
- the deflecting sheath includes at least one second perforation separated, in the axial direction, from the axial end by a portion of the deflecting sheath and including respective portions aligned with the first, second, and third perforations in the radial direction.

* * * * *